US010403455B2

(12) United States Patent
Lu

(10) Patent No.: US 10,403,455 B2
(45) Date of Patent: Sep. 3, 2019

(54) SWITCH STRUCTURE HAVING MANUAL AND AUTOMATIC MODE

(71) Applicant: proeasy network solutions co., LTD., Hsinchu County (TW)

(72) Inventor: Hsing-Hung Lu, Hsinchu County (TW)

(73) Assignee: proeasy network solutions co., LTD., Hsinchu County (TW)

( * ) Notice: Subject to any disclaimer, the term of this patent is extended or adjusted under 35 U.S.C. 154(b) by 0 days.

(21) Appl. No.: 15/884,402

(22) Filed: Jan. 31, 2018

(65) Prior Publication Data

US 2019/0180959 A1 Jun. 13, 2019

(30) Foreign Application Priority Data

Dec. 11, 2017 (TW) ..... 106143414 A

(51) Int. Cl.
*H01H 21/36* (2006.01)
*H01H 21/22* (2006.01)
*H01H 21/12* (2006.01)

(52) U.S. Cl.
CPC ..... *H01H 21/36* (2013.01); *H01H 21/12* (2013.01); *H01H 21/22* (2013.01)

(58) Field of Classification Search
CPC ..... H01H 43/00; H01H 43/005; H01H 21/36
See application file for complete search history.

(56) References Cited

U.S. PATENT DOCUMENTS 4,734,985 A * 4/1988 Ozaki ..... B67B 7/385 30/404

FOREIGN PATENT DOCUMENTS

TW I538002 6/2016

OTHER PUBLICATIONS

"Office Action of Taiwan Counterpart Application", dated May 10, 2018, p.1-p.3.

* cited by examiner

*Primary Examiner* — Vanessa Girardi
(74) *Attorney, Agent, or Firm* — JCIPRNET

(57) ABSTRACT

A switch structure used for switching on or off an electronic system is provided. The switch structure includes a base, a switch body pivoted to the base, a first electrode connected and moved along with the switch body, a second electrode disposed on the based and corresponds to the first electrode, a torsion assembly, and a power source. The first electrode and the second electrode are electrically connected to the electronic system, respectively. The torsion assembly is connected to and drives the switch body, so as to drive the first electrode and the second electrode to switch between a conductive state and a non-conductive state. The power source is connected to the torsion assembly, and the power source provides a torsion to the switch body via the torsion assembly in an automatic state so as to switch the switch structure between the conductive state and the non-conductive state.

5 Claims, 6 Drawing Sheets

SWITCH STRUCTURE HAVING MANUAL AND AUTOMATIC MODE

CROSS-REFERENCE TO RELATED APPLICATION

This application claims the priority benefit of Taiwan application serial no. 106143414, filed on Dec. 11, 2017. The entirety of the above-mentioned patent application is hereby incorporated by reference herein and made a part of this specification.

BACKGROUND OF THE INVENTION

1. Field of the Invention

The disclosure relates to a switch structure.

2. Description of Related Art

The invention of electricity has brought a complete lifestyle change to mankind, contributing to significant developments and advancements in industry and technology and bringing applications of various kinds of electronic circuits and information systems into our life. However, the climate anomalies which came along with the development in technology have gradually increased the environmental awareness of people. In response, various methods for improvement have been proposed for the energy source types and the efficiency thereof. However, regardless of any new energy source, in order to truly play an effect in carbon reduction, the principles of conservation need to be applied.

Aside from using electrical equipment with low energy consumption, the most important thing is to switch off the power of electrical equipment that is not in use to reduce the waste of unnecessary energy. In other words, not only can waste in electricity be effectively prevented by a means of good electricity management, safety in electricity usage is also provided. Therefore, for the various types of current electronic systems, in addition to proximal control, it is necessary to develop a means for performing remote control in order to increase the effectiveness in electricity management and at the same time achieving results in areas such as intelligent lifestyle and carbon reduction.

SUMMARY OF THE INVENTION

The invention is directed to a switch structure capable of improving use convenience by manual or automatic modes.

The switch structure of the invention is used for switching on or off an electronic system. The switch structure includes a base, a switch body, a first electrode, a second electrode, a torsion assembly, and a power source. The switch body is pivoted to the base. The first electrode is connected to the switch body and driven by the switch body. The second electrode is disposed on the base and corresponds to the first electrode, wherein the first electrode and the second electrode are electrically connected to the electronic system, respectively. The torsion assembly is connected to and drives the switch body, so as to drive the first electrode and the second electrode to switch between a conductive state and a non-conductive state. The power source is connected to the torsion assembly. The power source provides a torsion to the switch body via the torsion assembly in an automatic state so as to switch the switch structure between the conductive state and the non-conductive state.

In an embodiment of the invention, the switch structure further includes an engaging member. The torsion assembly includes a transmitting shaft connected between the power source and the switch body. The engaging member clamps the transmitting shaft in the automatic state, and the power source drives the switch body through the engaging member and the transmitting shaft.

In an embodiment of the invention, the engaging member is elastic, and a user applies a force on the switch body in a manual state to drive the transmitting shaft and deform the engaging member.

In an embodiment of the invention, the torsion assembly includes a reducing gear and a driving gear. The reducing gear is connected to the power source. The driving gear has an opening. The transmitting shaft is pivoted to the base and inserted to the opening. The engaging member is embedded in the driving gear and clamps the transmitting shaft. The driving gear is connected to the reducing gear.

In an embodiment of the invention, the driving gear has an accommodating slot located adjacent to the opening. The transmitting shaft has a first shaft portion, a second shaft portion and a third shaft portion which are coaxially disposed. The second shaft portion is located inside the opening. The third shaft portion is passed outside the opening. The first shaft portion is located in the accommodating slot and clamped by the engaging member.

In an embodiment of the invention, the torsion assembly further includes an interlocking piece. The third shaft portion has a turning hole. One end of the interlocking piece is inserted to the turning hole. Another end of the interlocking piece is inserted to the switch body.

In an embodiment of the invention, the torsion assembly further includes an interlocking piece. The interlocking piece is connected between the transmitting shaft and the switch body. The transmitting shaft rotates the switch body through the interlocking piece in the automatic state. The switch body rotates the transmitting shaft through the interlocking piece in the manual state.

In an embodiment of the invention, the switch structure further includes a control module electrically connected to the power source.

Based on the above, by disposing the torsion assembly in the switch structure, the torsion assembly may be connected between the switch body and the power source. Accordingly, in the automatic state, the power source drives the torsion assembly to provide the torsion to the switch body so different rotating positions of the switch body can have the first electrode and the second electrode in the base close connected to or moved away from each other. In this way, electrical conduction or electrical open circuit may be provided to switch on or off the electronic system.

To make the above features and advantages of the disclosure more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
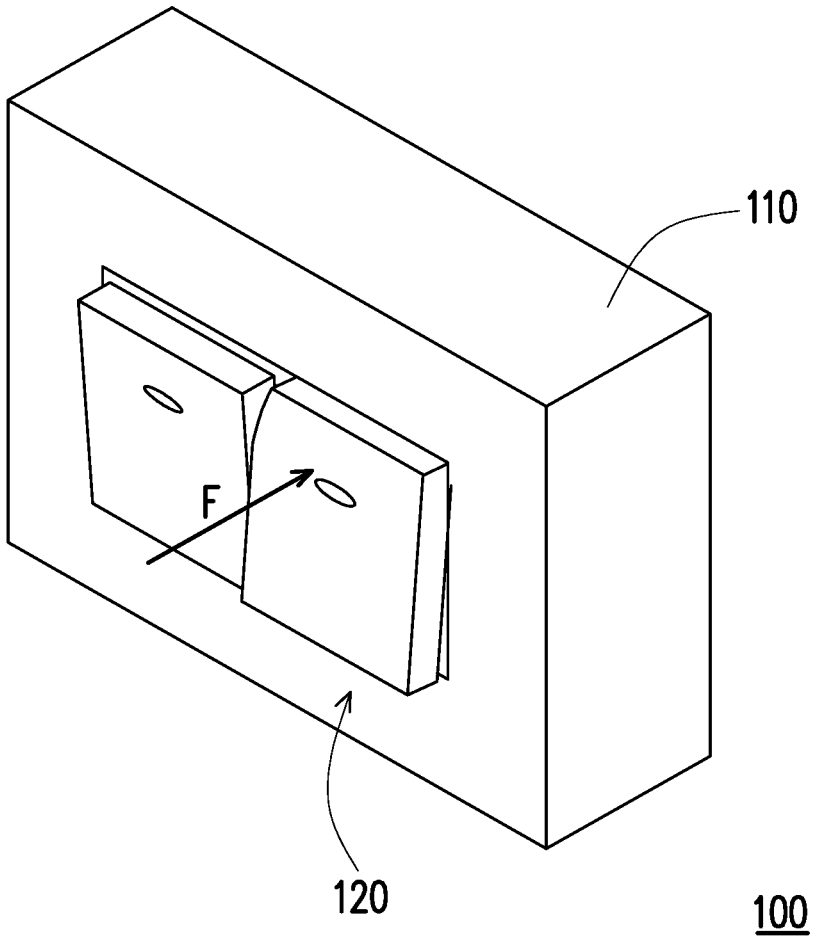
FIG. 1 is a schematic drawing of a switch structure according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
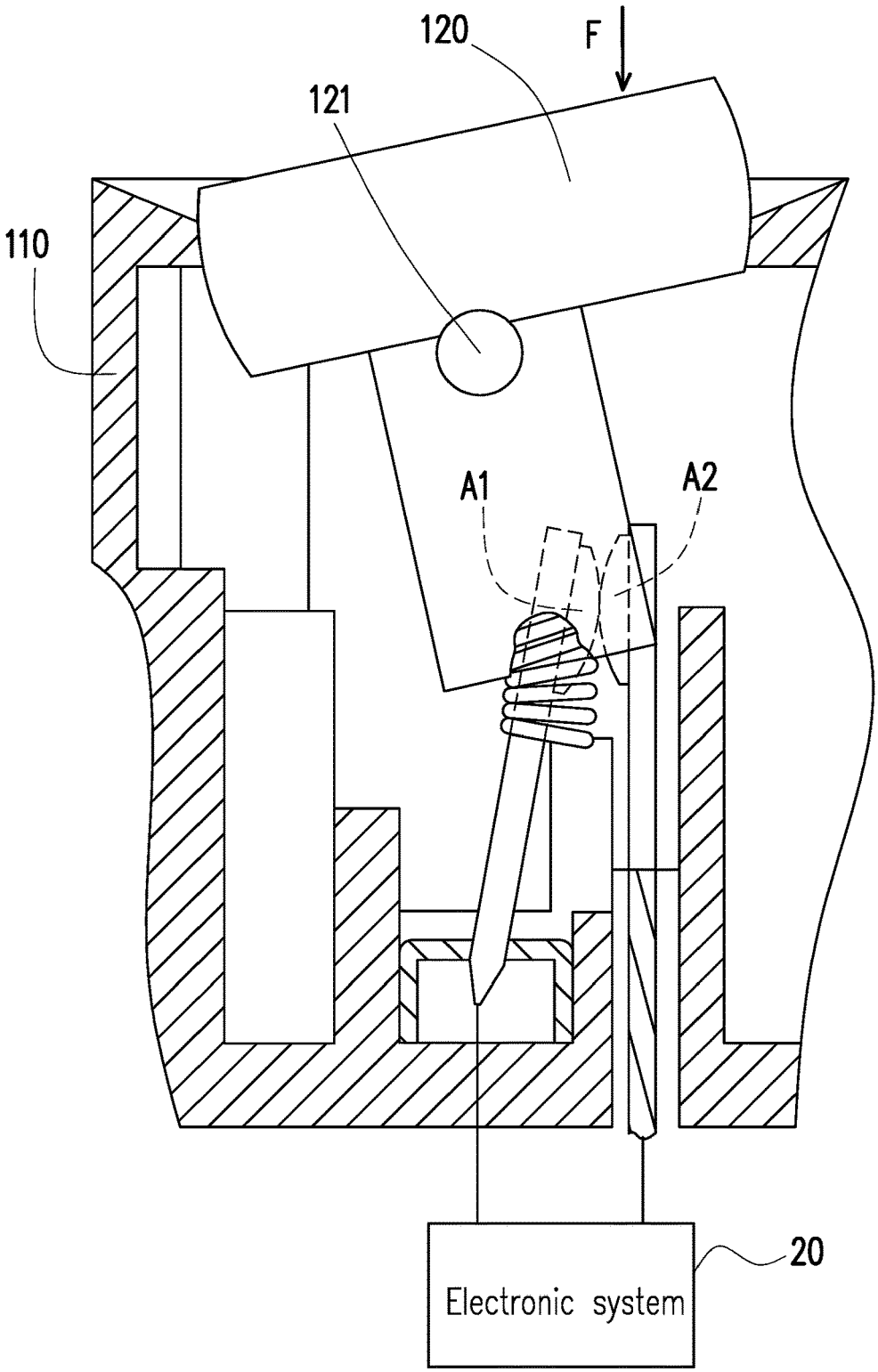
FIG. 2 is a partial cross-sectional view of the switch structure of FIG. 1.

FIG. 1 is a schematic drawing of a switch structure according to an embodiment of the invention. FIG. 2 is a partial cross-sectional view of the switch structure of FIG. 1. Referring to FIG. 1 and FIG. 2 together, in the present embodiment, a switch structure 100 is used for switching on or off an electronic system 20. Herein, the electronic system 20 refers to various electronic devices or circuit systems applicable in general household. Here, the switch structure 100 includes a base 110, a switch body 120, a first electrode A1 and a second electrode A2, The first electrode A1 and the second electrode A2 are electrically connected to the electronic system 20, respectively. The second electrode A2 is disposed in the base 110, and the first electrode A1 is substantially attached on the switch body 120 and moved along with the switch body 120. As shown in FIG. 2, each of the first electrode A1 and the second electrode A2 is electrically connected to the electronic system 20 by respective terminal structures.

The switch body 120 is, for example, a handle portion of a rocker switch substantially pivoted to the base 110 and can be forced to rotate and move so the first electrode A1 and the second electrode A2 can be switched between a conductive state (as shown in FIG. 2) and a non-conductive state. In the conductive state shown in FIG. 2, a user can have the switch body 120 rotated in clockwise direction by an applied force F such that the first electrode A1 and the second electrode A2 are moved away from each other in order to form the non-conductive state. Correspondingly, if the applied force F is applied to a left side of the switch 120 in the non-conductive state, the conductive state may again be switched back to the conductive state shown in FIG. 2.

Figure 3:
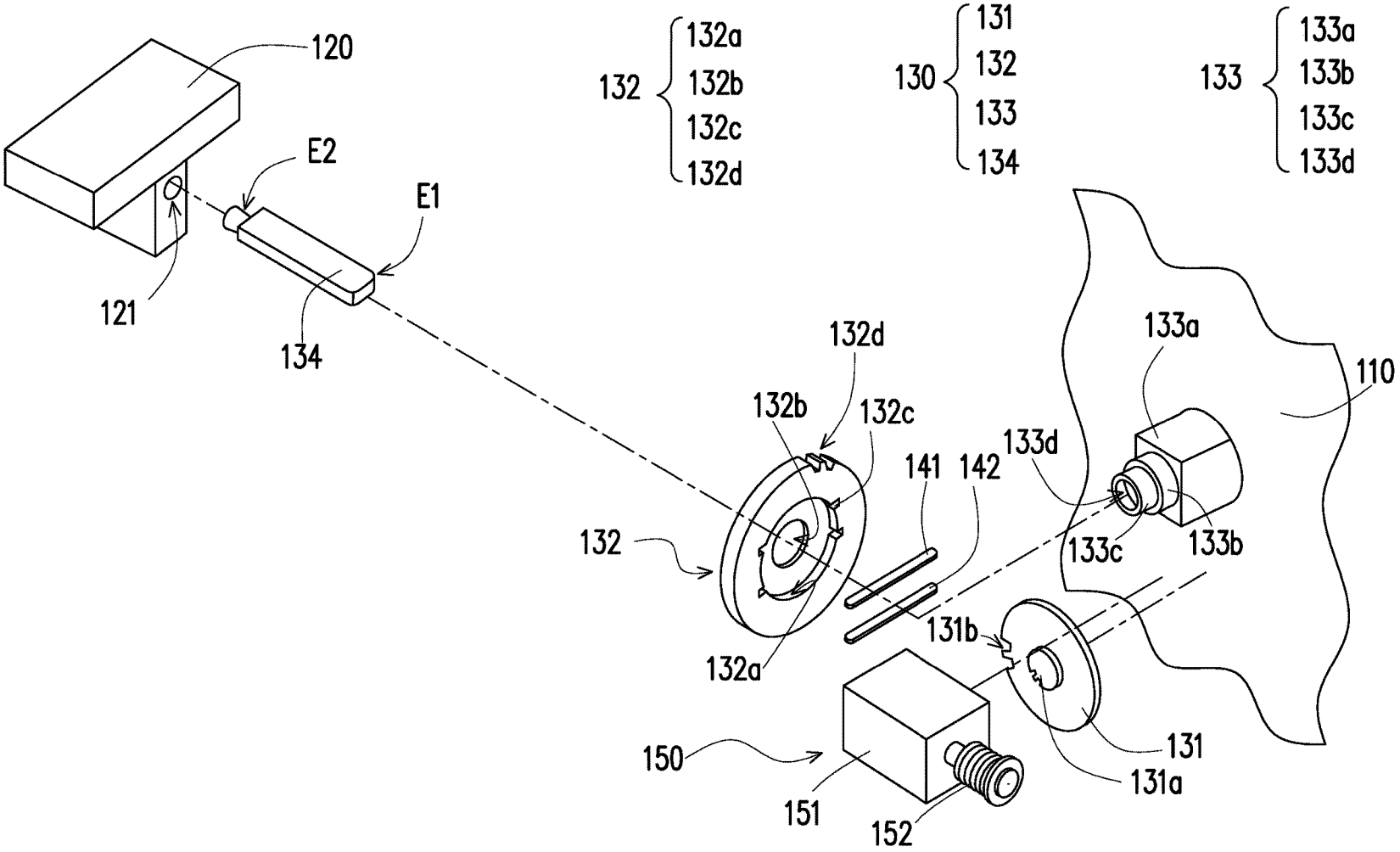
FIG. 3 is a schematic drawing for assembling a part of components in the switch structure of FIG. 1.
Figure 4:
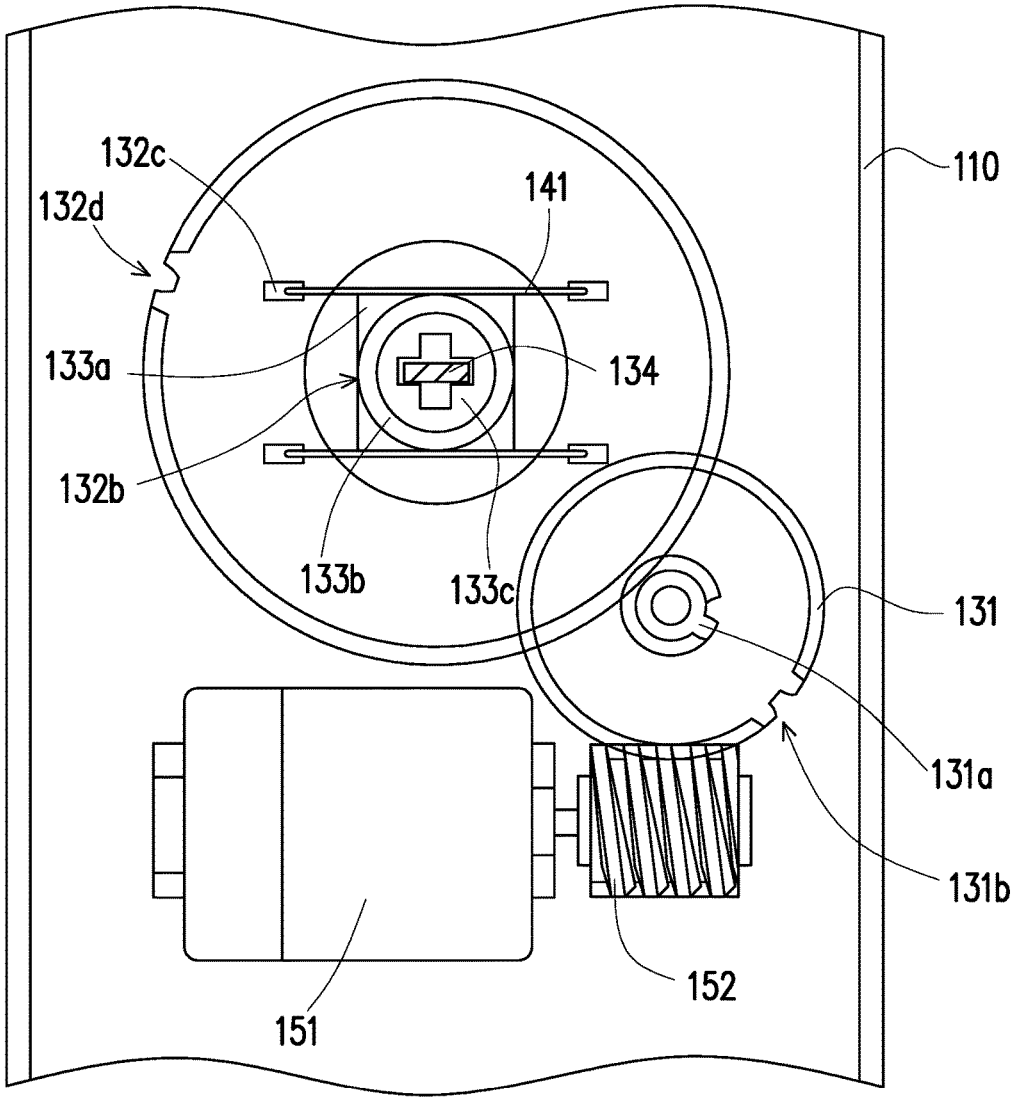
FIG. 4 is a simple side view of the components of FIG. 3 after assembly is completed.

FIG. 3 is a schematic drawing for assembling a part of components in the switch structure of FIG. 1. FIG. 4 is a simple side view of the components of FIG. 3 after assembly is completed. Referring to FIG. 2 to FIG. 4 together, specifically, in the present embodiment, the switch structure 100 further includes a torsion assembly 130, an engaging member (141, 142) and a power source 150. As shown in FIG. 3, the torsion assembly 130 includes a reducing gear 131, a driving gear 132, a transmitting shaft 133 and an interlocking piece 134. The power source 150 is, for example, a motor, which includes a main body 151 and a screw rod 152 (or a worm gear). As shown in FIG. 3 and FIG. 4, the screw rod 152 is meshed with a transmitting tooth 131*b* of the reducing gear 131, and the reducing gear 131 further includes a transmitting tooth 131*a*, which is concentrically disposed together with the transmitting tooth 131*b* and meshed with a transmitting tooth 132*d* of the driving gear 132. In this way, a driving force generated by the power source 150 may be transmitted to the driving gear 132 via the screw rod 152 and the reducing gear 131. It should be noted that, since contour outlines of the gears are well-known knowledge in the related art, the gear components are all illustrated by simplified diagrams in the drawings of the present application.

Moreover, the driving gear 132 further includes an opening 132*b* and an accommodating slot 132*a* (with contour of an expanding hole), and the transmitting shaft 133 includes a first shaft portion 133*a*, a second shaft portion 133*b* and a third shaft portion 133*c* which are coaxially disposed and have different contours and outer diameters. The second shaft portion 133*b* and the third shaft portion 133*c* are inserted to the opening 132*b*. The second shaft portion 133*b* is located inside the opening 132*b* such that the third shaft portion 133*c* is passed outside the opening 132*b*, and the first shaft portion 133*a* leans against the accommodating slot 132*a*. It should be noted that, the driving gear 132 further includes fitting slots 132*c* located at a periphery of the accommodating slot 132*a* and corresponding to each other, and the engaging pieces 141 and 142 are elastic pieces embedded in the fitting slots 132*c* for leaning against two opposite lateral edges of the first shaft portion 133*a*. Here, the first shaft portion 133*a* may be regarded as a rectangular block, with two opposite sides clamped by the engaging members 141 and 142.

On the other hand, the transmitting shaft 133 further includes a turning hole 133*d* located on the third shaft portion 133*c*. A first end E1 of the interlocking piece 134, which is a flat piece, is inserted to the turning hole 133*d* (i.e., a contour of the turning hole 133*d* can fit in the first end E1 of the interlocking piece 134). A second end E2 of the interlocking piece 134 is inserted to a shaft hole 121 of the switch body 120. Therefore, when the transmitting shaft 133 rotates, the switch body 120 can be driven to rotate by the interlocking piece 134. Relatively, when the power source 150 conducts a backwards driving, the transmitting shaft 133, the interlocking piece 134 and the switch body 120 may also rotate backwards.

Accordingly, when the power source 150 provides power to drive the reducing gear 131 and the driving gear 132 for rotation, the transmitting shaft 133 may be driven to rotate by the engaging members 141 and 142. In this way, the switch body 120 and the first electrode A1 can be driven to move and switch between the conductive state and the non-conductive state in order to achieve the purpose of switching on or off the electronic system 20.

Figure 5:
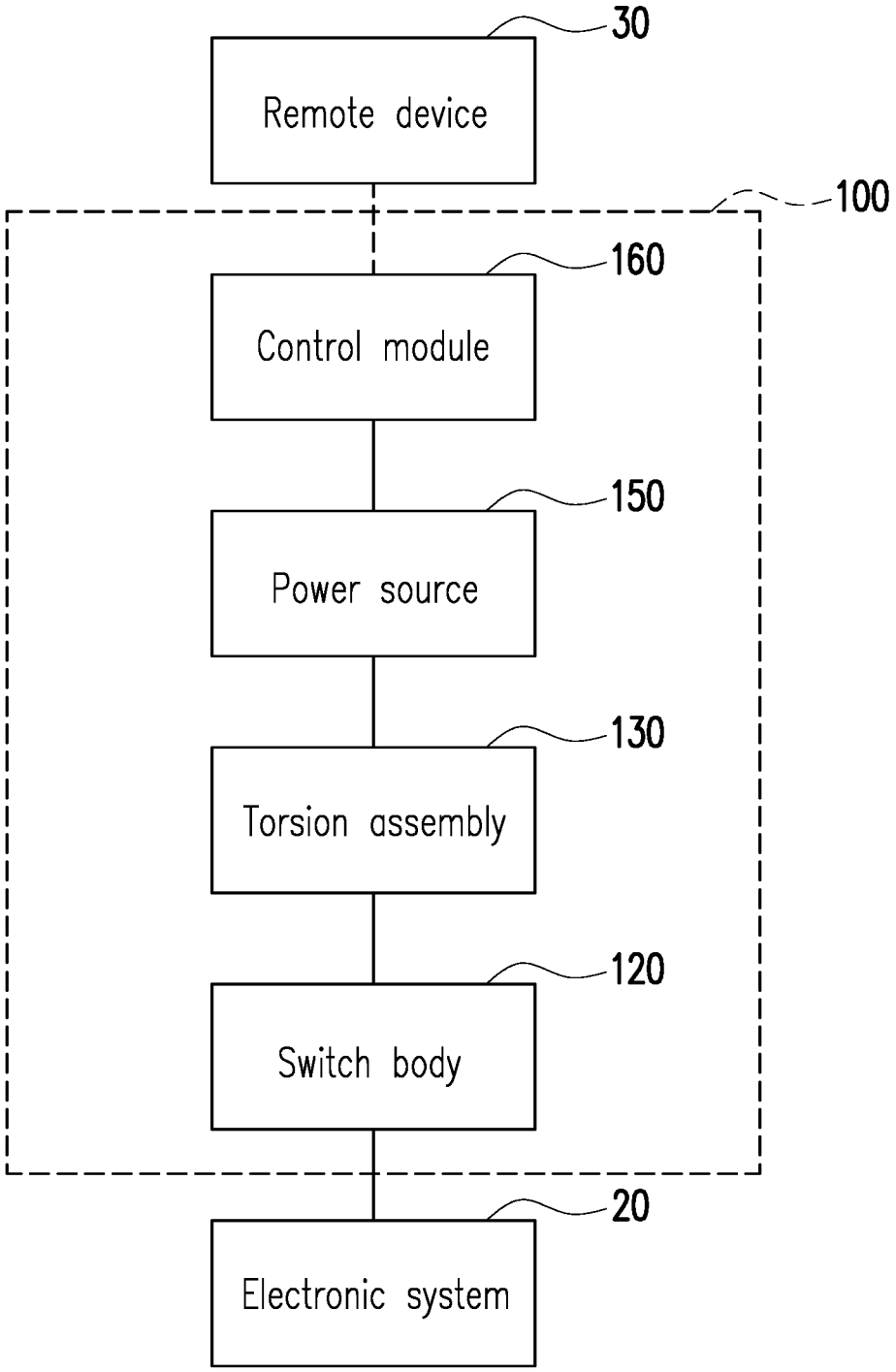
FIG. 5 is a schematic diagram of an electrical connection of the switch structure of FIG. 1.

FIG. 5 is a schematic diagram of an electrical connection of the switch structure of FIG. 1. The switch structure 100 further includes a control module 160, which is electrically connected to the power source 150 so the user can set up conditions for the control module 160 to switch on or off the power source 150 accordingly, thereby achieving a desired switching effect. In addition, the control module 150 is also adapted to receive a wireless signal of a remote device 30 and accordingly switch on or off the power source 150. As such, the user is able remotely control the switch structure 100 to achieve a smart home effect.

Referring back to FIG. 3 and FIG. 4, when the power source 150 cannot be started due to power failure, the user can still manually provide the applied force F to the switch body switch 120 so as to decide the effect of switching on or off for the switch structure 100. More specifically, because the engaging members 141 and 142 are the elastic pieces, when the applied force F is provided to the switch body 120, the transmitting shaft 133 is driven by the interlocking piece 134 so the first shaft portion 133*a* (the rectangular block) of the transmitting shaft 133 can overcome a clamping effect of the engaging members 141 and 142 on the transmitting shaft 133 by a greater power. Accordingly, the engaging members 141 and 142 may be expanded outwardly so the engaging members 141 and 142 can closely lean against the two opposite lateral edges of the first shaft portion 133*a* respectively at top and down positions, as shown in FIG. 4. Therefore, when the applied force F drives the transmitting shaft 133 to rotate, the first shaft portion 133*a* (the rectangular block) can open up the engaging members 141 and 142 respectively in upward and downward directions and continue to rotate. Until the applied force F is stopped after the rotation reaches 90 degrees, the engaging members 141 and 142 can lean against the two opposite lateral edges of the first shaft portion 133*a* again due to elastic recovery. Accordingly, the situation where the switch structure 100 cannot be switched on or off due to the power failure or malfunction of the control module 160 and the power source 150 may be solved.

Figure 6:
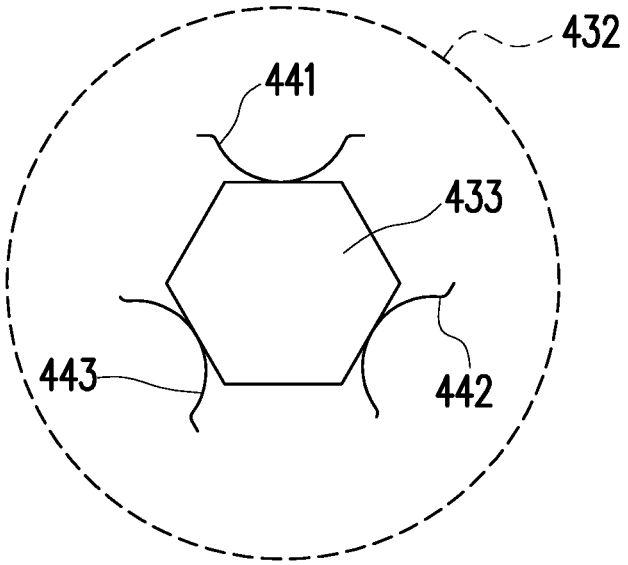
FIG. 6 and FIG. 7 are schematic partial views of different embodiments of the invention, respectively.
Figure 7:
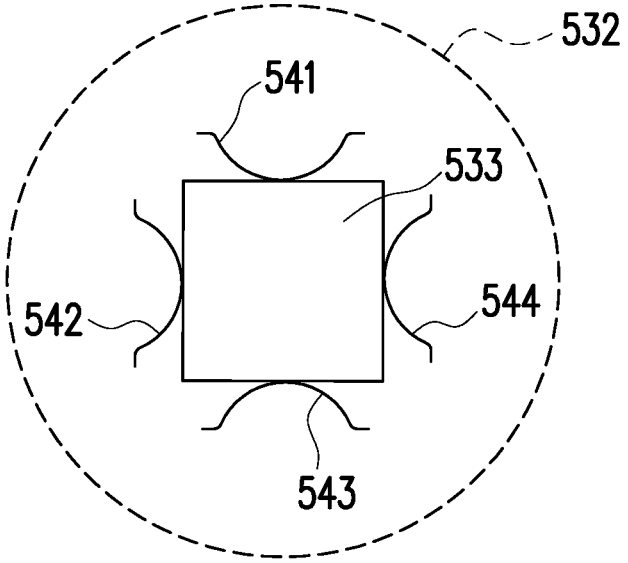

FIG. 6 and FIG. 7 are schematic partial views of different embodiments of the invention, respectively. Only relevant components are illustrated here with reference to FIG. 4. With reference to FIG. 6, in the present embodiment, three engaging members 441, 442 and 443 are disposed on a driving gear 432, and (a first shaft portion of) the transmitting shaft is a six-sided pillar. The engaging members 441, 442 and 443 lean against three pillar surfaces on the six-sided pillar, and have pushing forces with respect to the transmitting shaft in a balanced state. Accordingly, aside from achieving a clamping relation between the transmitting shaft 133 and the engaging members 141 and 142 as described above, the effect of switching on or off in a manual state may be also be achieved by driving the transmitting shaft 432 to deform the engaging members 441, 442 and 443. However, the difference is that, a rotation angle of a transmitting shaft 433 in the present embodiment is smaller (which is 90 degree in the foregoing embodiment, and 60 degrees in the present embodiment), so a power saving (including the applied force F or electrical power required by the power source 150) effect can be achieved. Similarly, a transmitting shaft 533 shown in the embodiment of FIG. 7 is similar to the rectangular block of the FIG. 4, and the difference is that there are four engaging members 541, 542, 543 and 544 respectively leaning against four side edges of the rectangular block. In addition to a larger clamping force provided for the transmitting shaft 533, this approach can also maintain the same driving effect as described above even if one of the engaging members is malfunction.

In summary, in the foregoing embodiments of the invention, by disposing the torsion assembly in the switch structure, the torsion assembly may be connected between the switch body and the power source. Accordingly, in the automatic state, the power source drives the torsion assembly to provide the torsion to the switch body so different rotating positions of the switch body can have the first electrode and the second electrode in the base close connected to or moved away from each other. In this way, electrical conduction or electrical open circuit (where current cannot pass through) may be provided to switch on or off the electronic system.

Furthermore, in the switch structure, the engaging member is disposed on the driving gear of the torsion assembly and clamps the transmitting shaft of the torsion assembly, and the transmitting shaft is further connected to the switch body by the interlocking piece. Accordingly, in the automatic state, when the power provided by the power source is driving the torsion assembly, the transmitting shaft may be clamped by the engaging member to transmit the power to the switch body. Meanwhile, because the engaging member is elastic, when the power source is not switched on yet, the user can still apply force on the switch body so the deformation of the engaging members can be overcame by the applied force, allowing the transmitting shaft to successfully rotate, thereby achieving the purpose of switching on or off the electronic system.

As a result, the switch structure is provided with operation modes such as the automatic (powered) state and the manual state to achieve effectiveness of improving use convenience and wide application range.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A switch structure used for switching on or off an electronic system, the switch structure comprising:
   - a base;
   - a switch body, pivoted to the base;
   - a first electrode, connected to the switch body and driven by the switch body;
   - a second electrode, disposed on the base and corresponding to the first electrode, wherein the first electrode and the second electrode are electrically connected to the electronic system, respectively;
   - a torsion assembly, being connected to and driving the switch body, so as to drive the first electrode and the second electrode to switch between a conductive state and a non-conductive state;
   - a motor, connected to the torsion assembly, the motor providing a torsion to the switch body via the torsion assembly in an automatic state so as to switch the switch structure between the conductive state and the non-conductive state;
   - a control module, electrically connected to the motor, wherein the control module is adapted to receive a wireless signal of a remote device and accordingly switch on or off the motor; and
   - an engaging member, the torsion assembly comprising a transmitting shaft connected between the motor and the switch body, the engaging member clamping the transmitting shaft in the automatic state, the motor driving the switch body through the engaging member and the transmitting shaft, wherein the engaging member is elastic, and a user applies a force on the switch body in a manual state to drive the transmitting shaft and deform the engaging member.

2. The switch structure of claim 1, wherein the torsion assembly further comprises an interlocking piece, the interlocking piece is connected between the transmitting shaft and the switch body, the transmitting shaft rotates the switch body through the interlocking piece in the automatic state, and the switch body rotates the transmitting shaft through the interlocking piece in the manual state.

3. The switch structure of claim 1, wherein the torsion assembly comprises:
   - a reducing gear, connected to the motor; and
   - a driving gear, having an opening, the transmitting shaft being pivoted to the base and inserted to the opening, the engaging member being embedded in the driving gear and clamping the transmitting shaft, the driving gear being connected to the reducing gear.

4. The switch structure of claim 3, wherein the driving gear has an accommodating slot located adjacent to the opening, the transmitting shaft has a first shaft portion, a second shaft portion and a third shaft portion which are coaxially disposed, the second shaft portion is located inside the opening, the third shaft portion is passed outside the opening, and the first shaft portion is located in the accommodating slot and clamped by the engaging member.

5. The switch structure of claim 4, wherein the torsion assembly further comprises an interlocking piece, the third shaft portion has a turning hole, one end of the interlocking piece is inserted to the turning hole, and another end of the interlocking piece is inserted to the switch body.

* * * * *